US007834529B2

(12) United States Patent
Chang

(10) Patent No.: US 7,834,529 B2
(45) Date of Patent: Nov. 16, 2010

(54) SPARK PLUG WITH RIVETED SLEEVE

(76) Inventor: Wen-Fong Chang, 3708 41st Ave., NE., Seattle, WA (US) 98105

( * ) Notice: Subject to any disclaimer, the term of this patent is extended or adjusted under 35 U.S.C. 154(b) by 133 days.

(21) Appl. No.: 12/205,868

(22) Filed: Sep. 6, 2008

(65) Prior Publication Data

US 2009/0066210 A1 Mar. 12, 2009

(30) Foreign Application Priority Data

Sep. 7, 2007 (TW) ..... 96215065 U
Jun. 4, 2008 (TW) ..... 97209856 U

(51) Int. Cl.
*F02M 57/06* (2006.01)
*F02P 13/00* (2006.01)
*H01T 13/00* (2006.01)

(52) U.S. Cl. ..... 313/118; 313/141; 313/143

(58) Field of Classification Search ..... 313/118, 313/132, 137, 141–143, 145
See application file for complete search history.

(56) References Cited

U.S. PATENT DOCUMENTS

| | | | | |
|---|---|---|---|---|
| 4,695,758 | A | 9/1987 | Nishida et al. | |
| 4,798,991 | A | 1/1989 | Benedikt et al. | |
| 7,305,954 | B2 | 12/2007 | Hagiwara et al. | |
| 2003/0001474 | A1 * | 1/2003 | Teramura et al. | 313/141 |
| 2007/0046162 | A1 * | 3/2007 | Moribe et al. | 313/143 |
| 2007/0052336 | A1 * | 3/2007 | Liao | 313/141 |
| 2007/0069617 | A1 * | 3/2007 | Tozzi et al. | 313/140 |
| 2007/0114901 | A1 * | 5/2007 | Nagasawa et al. | 313/141 |
| 2007/0236122 | A1 * | 10/2007 | Borror | 313/118 |
| 2009/0140623 | A1 * | 6/2009 | Ugalde | 313/141 |

FOREIGN PATENT DOCUMENTS

| | | |
|---|---|---|
| CN | 2450808 | 9/2001 |
| CN | 2534708 | 2/2003 |
| CN | 2534708 | 8/2003 |
| CN | 2569379 | 8/2003 |
| CN | 2585456 | 11/2003 |
| CN | 1665087 | 9/2005 |
| TW | 00267615 | 1/1996 |
| TW | 00299924 | 3/1997 |
| TW | 200624669 | 7/2006 |

* cited by examiner

*Primary Examiner*—Bumsuk Won
*Assistant Examiner*—Kevin Quarterman

(57) ABSTRACT

A spark plug comprising a housing, a ceramic insulator and a sleeve is provided. The housing has an inner cavity while the ceramic insulator encloses a central electrode. The ceramic insulator is disposed inside the inner cavity and maintain from the housing with a gap. The sleeve is provided enclosing an inner wall of the housing and corresponds to an opening of the inner cavity. The level of an edge surface of the housing corresponding to the opening of the inner cavity is disposed higher than the level of an edge surface of the central electrode, and the level of the center electrode is also higher than the level of the edge surface of the ceramic insulator.

19 Claims, 10 Drawing Sheets

SPARK PLUG WITH RIVETED SLEEVE

This application claims priority based on both Taiwanese patent applications No. 096215065 filed on Sep. 7, 2007 and No. 097209856 filed on Jun. 4, 2008.

BACKGROUND OF THE INVENTION

1. Field of the Invention

The present invention relates to a spark plug, and more particularly to a spark plug that can protect a discharge spark.

2. Description of the Relative Art

A motorcycle or gasoline vehicle's engine is equipped with spark plugs to ignite fire and generate power. Generally, when spark plugs form a high discharge voltage, the engine introduces air via an intake manifold to form a fuel-air mixture into a cylinder almost at the same time, and generates power by igniting fuel-air mixture by discharge spark. However, the forms of the spark plug are different according to engine's design.

FIG. 1 shows a conventional spark plug 10. As shown in FIG. 1, the spark plug 10 includes a housing 12, a ceramic insulator 14, and a central electrode 16. One end of the housing 12 extends and forms a ground contacted electrode 18. The ground contacted electrode 18 is perpendicular to the central electrode 16 and is apart from the central electrode 16 with a gap 24. The gap 24 is where a high voltage discharge spark formed (not shown). Besides, the other end of the spark plug 10 covers by an insulator 20 for preventing a short circuit or electric leakage. The insulator 20 further connects to a connecting head 22. The ceramic insulator 14 may enclose a sealing material such as aluminum oxide and a seal ring between the ceramic insulator 14 and the housing 12 in assembly such that the ceramic insulator 14 and the housing 12 may form an air-seal structure for preventing pressure from leaking out from the engine while assembles the housing 12.

Referring to FIG. 2, the conventional spark plug 10 is disposed on an engine 30, and a discharge spark 26 forms between the central electrode 16 and the ground contacted electrode 18. When fuel-air mixture 40 enter into a combustion chamber 32 and the piston 34 go up to Top Center Point, the air fuel mixture 40 ignites by the exposed discharge spark 26 in the combustion chamber 32 of the engine 30 directly, thereby drives a piston 34 of the engine 30 to generate power. However, when stepping on the gas pedal heavily to speed up suddenly or other circumstances, a large amount of high pressure fuel-air mixture 40 will enter into the combustion chamber 32 speedily and breach the discharge spark 26. Therefore, the discharge spark 26 may snuff out and affect the ignited efficiency of the spark plug 10, such that causes the moving motorcycle or vehicle cannot speed up smoothly.

SUMMARY OF THE INVENTION

It is an objective of the present invention to provide a spark plug that can enable a moving vehicle to speed up smoothly.

It is another objective of the present invention to provide a spark plug with a long life span.

It is still another objective of the present invention to provide a spark plug that can protect a discharge spark form.

It is another objective of the present invention to provide a spark plug whose discharge spark is not affected by the fuel-air mixture.

A spark plug of the present invention includes a housing, a ceramic insulator and a sleeve. The housing has an inner cavity while the ceramic insulator encloses a central electrode. The ceramic insulator is disposed in the inner cavity and maintain from the housing with a gap. The sleeve encloses an inner wall and corresponds to the opening of the inner cavity. The level of the housing corresponding to the edge surface of the opening of the inner cavity is higher than the level of the edge surface of the central electrode, and the level of the edge surface of the central electrode is also higher than the level of the edge surface of the ceramic insulator.

In other words, the housing corresponding to the outer sidewall of the opening of the inner cavity protrudes out from the edge surface of the central electrode, and the edge surface of the central electrode also protrudes out from the edge surface of the ceramic insulator. From another point of view, the level of the edge surface of the central electrode is lower than the level of the edge surface of the housing corresponding to opening of the inner cavity, and the level of the edge surface of the ceramic insulator is also lower than the level of the edge surface of the central electrode.

In the preferable embodiment, the housing further has a protrusion and corresponds to the opening of the inner cavity. The level of the protrusion is higher than the edge surface of the central electrode, and the inner diameter of the protrusion is smaller than the inner diameter of the inner cavity. An inclined surface is disposed outside the edge surface of the housing and has a top end surface. The protrusion has a plane connects to the top end surface, and the plane is parallel to a central axis of the central electrode. The sleeve has a bending portion in contacts with the top end surface for positioning on the inner wall of the protrusion. Moreover, the side of the housing is further machined process at least one through hole. The through hole is parallelly communicated with the gap from the outer sidewall of the housing, and the level of the through hole is lower than the edge surface of the ceramic insulator.

DETAILED DESCRIPTION OF THE PREFERRED EMBODIMENT

The present invention provides a spark plug that can enable a smooth ignition process of an engine even when a large amount of fuel-air mixture is generated suddenly. In other words, when hardly stepping (Kick down) on the gas pedal (e.g. speeding up or climbing a slope), a discharge spark would not snuff out by of the breach of the large amount of fuel-air mixture and thereby the ignition process is smoothly without interruption. In the preferable embodiment, the spark plug can be applied to motorcycles, vehicles, internal combustion engines and agricultural car. The preferred embodiments of the present invention are illustrated hereunder with attached drawings.

Figure 1:
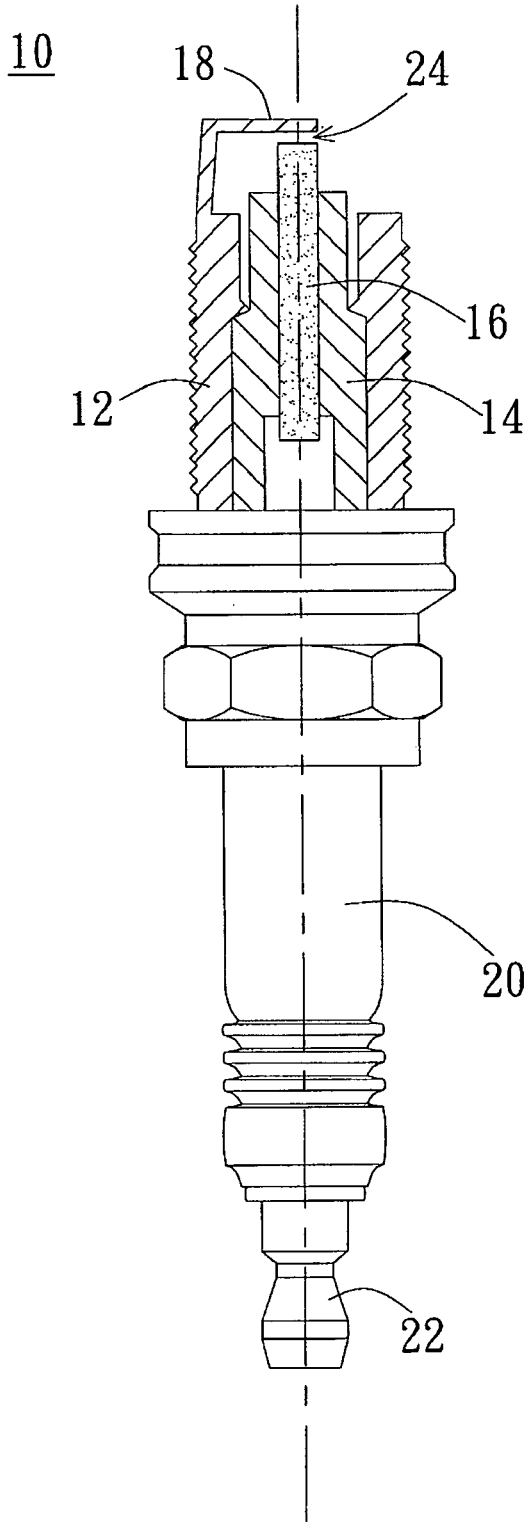
Fig. 1 (PRIOR ART)
FIG. 1 illustrates a perspective view of a spark plug of the prior art.
Figure 2:
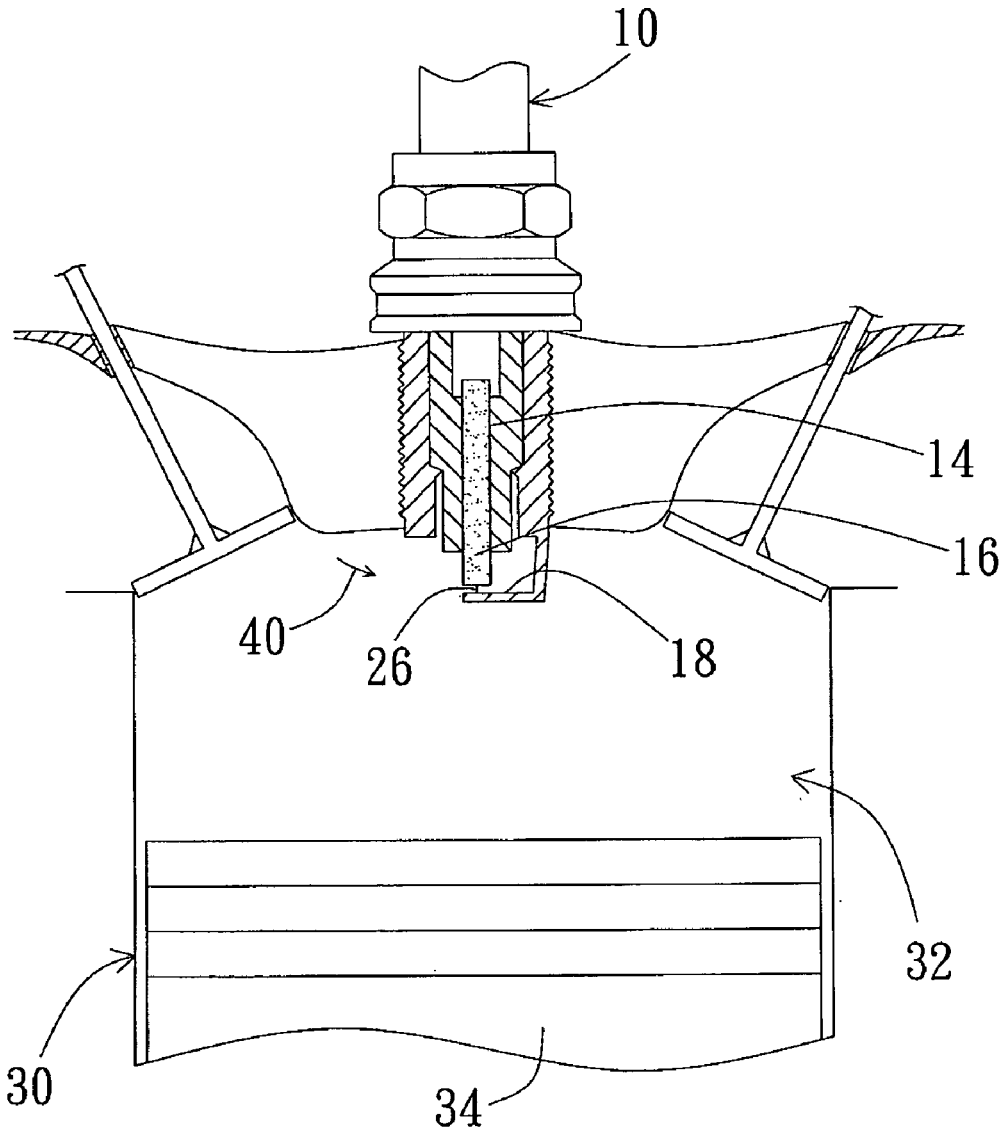
Fig. 2 (PRIOR ART)
FIG. 2 illustrates a perspective view of the spark plug disposed on an engine of the prior art.
Figure 3:
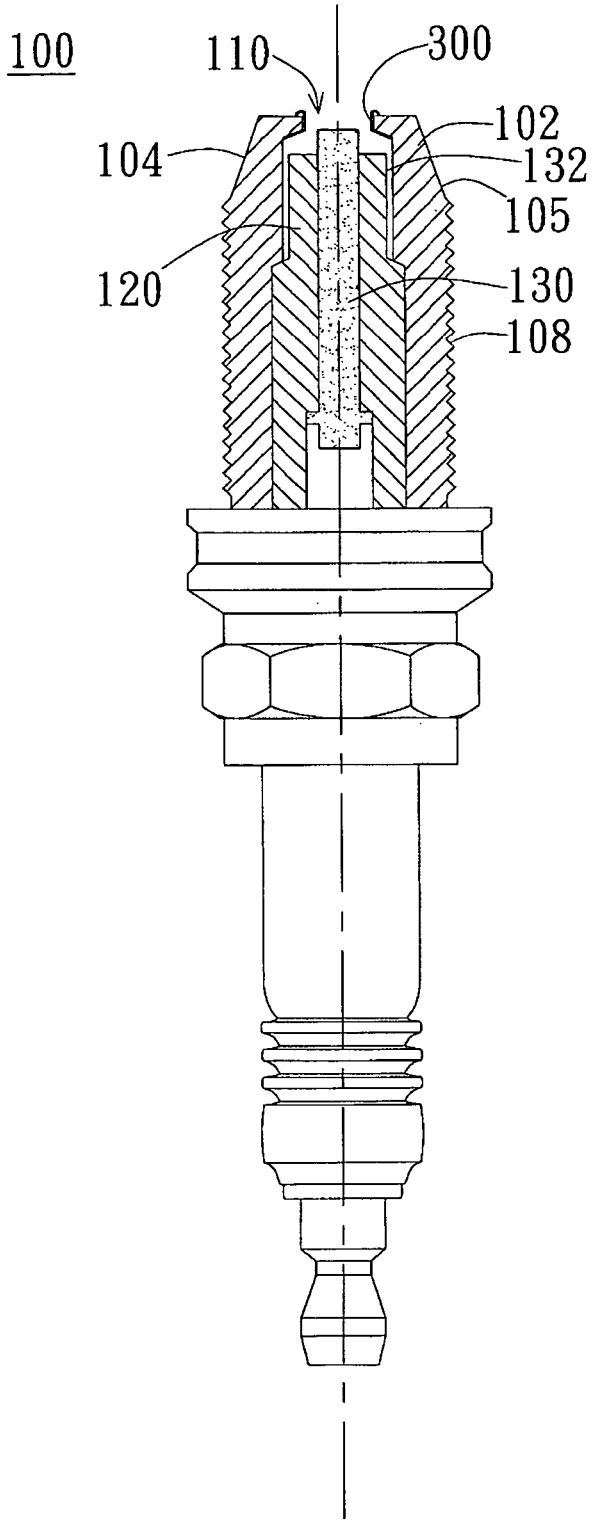
FIG. 3 illustrates a first embodiment view of the spark plug of the present invention.

Referring to FIG. 3, a spark plug 100 of the present invention includes a housing 102, a ceramic insulator 120, and a sleeve 300. The housing 102 is shaped a hollow shell and forms an inner cavity 100 thereof. The inner cavity 110 accommodates the ceramic insulator 120 and a central electrode 130 enclosed by the ceramic insulator 120. In the present embodiment, the outer sidewall of the housing 102 has an inclined surface 104 and an outside screw 108. The inclined surface 104 preferably intersects the horizontal with a 60-degrees angle. However, the angle may include between 45 degrees and 60 degrees by the inclined surface 104 and the horizontal, and the inclined surface 104 may be shaped cruciform or other shapes. The outside screw 108 connects with the inclined surface 104 for engaging with the engine (not shown). The central electrode 130 is preferably a straight stick; however, in other embodiments, the central electrode 130 may be shaped a cone at the top end or in other shapes. A gap forms 132 between the ceramic insulator 120 and the housing 102 and with a certain level.

The housing 102 corresponding to the edge surface of the opening of the inner cavity 110 is preferably higher than the level of the edge surface of the central electrode 130, and the level of the edge surface of the central electrode 130 is also higher than the level of the edge surface of the ceramic insulator 120. In other words, the housing 102 corresponding to the outer sidewall 105 of the opening of the inner cavity 110 protrudes out from the edge surface of the central electrode 130, and the edge surface of the central electrode 130 may also protrude out from the edge surface of the ceramic insulator 120. In the present embodiment, the outer sidewall 105 of the housing 102 protrudes out from the edge surface of the central electrode 130 including 5 mm to 20 mm. From another point of view, the level of the edge surface of the central electrode 130 is lower than the level edge surface of the housing 102 corresponding to the opening of the inner cavity 110, and the level of the edge surface of the ceramic insulator 120 may also lower than the level of the edge surface of the central electrode 130. Therefore, when the spark plug 100 is electrically conducted, the discharge spark (not shown) may form inside the inner cavity 110. In other words, the discharge spark is hided inside the housing of the spark plug 100.

Figure 4:
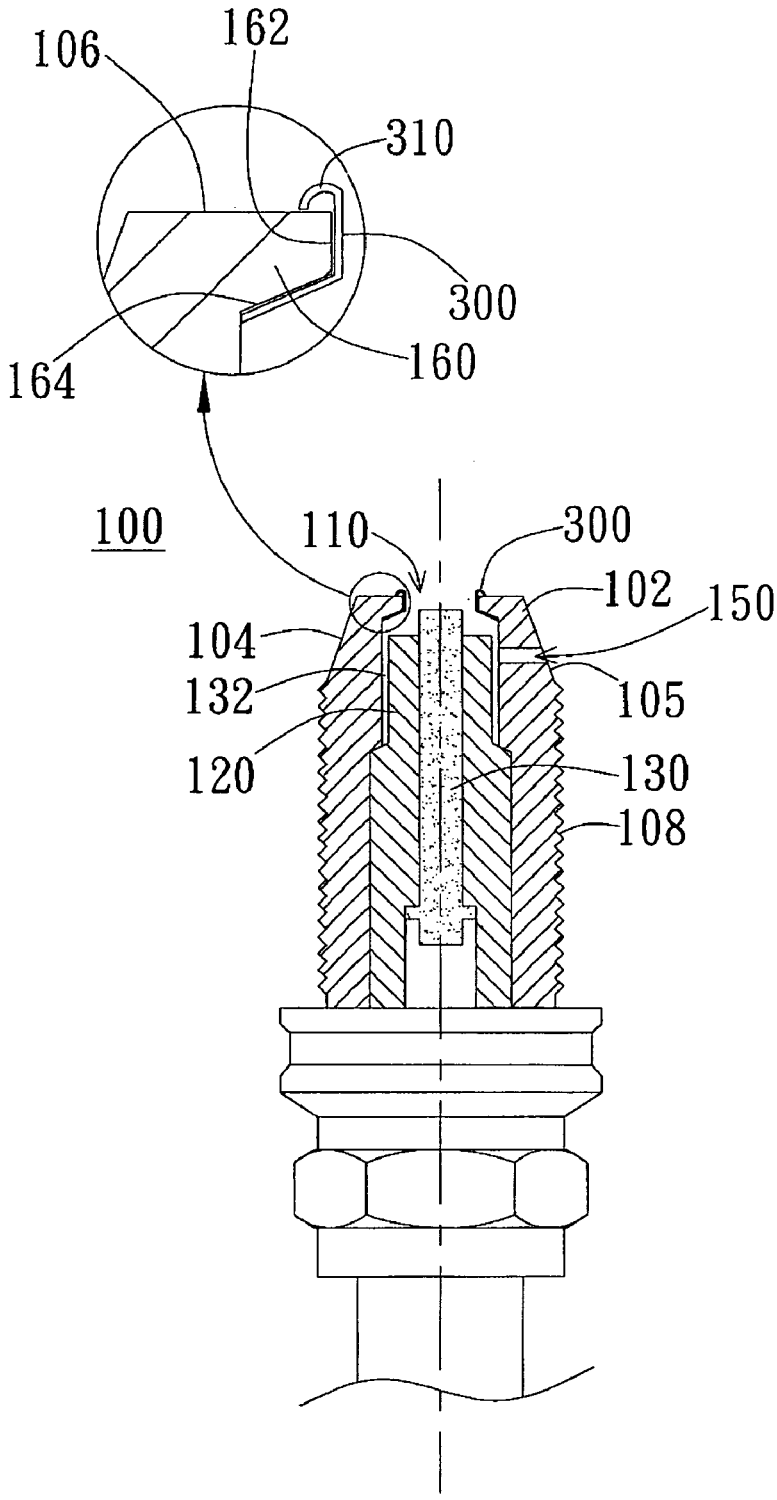
FIG. 4 illustrates a second embodiment view of the spark plug of the present invention.

FIG. 4 illustrates another embodiment of the present invention. In the present embodiment, the housing 102 includes at least one through hole 150. However, in the embodiment shown in FIG. 5, the housing 102 may include a plurality of through holes 150. The through hole 150 is parallelly communicated through the gap 132 from the outer sidewall 105 of the housing 102, and the level of the through hole 150 is disposed lower than the level of the edge surface of the ceramic insulator 120. However, in other embodiments, the level of the through hole 150 may also be disposed the same as the level of the edge surface of the ceramic insulator 120. In the embodiment shown in FIG. 4, the diameter of the through hole 150 is preferably between 2 mm and 14 mm.

Moreover, the inclined surface 104 of the housing 102 further connects to the top end surface 106. The top end surface 106 is a plane parallel to the horizontal. The housing 102 further has a protrusion 160 corresponding to the inner cavity 110. The level of the protrusion 160 is disposed higher than the edge surface of the central electrode 130, and an inner diameter of the protrusion 160 is smaller than an inner diameter of the inner cavity 110. In the present embodiment, the protrusion 160 further has a plane 162 and an inclined surface 164. The plane 162 connects with the top end surface 106 and is preferably perpendicular to the top end surface 106. The inclined surface 164 connects with the plane 162. However, in other embodiments, the plane 162 may be a plane not perpendicular to the horizontal, and the inclined surface 164 may be parallel to the horizontal. One end of the sleeve 300 further has a bending portion 310 bent outward and in contacts with the top end surface 106, so as to position at the inner sidewall of the housing 102. That is, the sleeve 300 has a through hole 330 and a sidewall 320 surrounding the through hole 330. The through hole 330 corresponds to the opening of the inner cavity 110, i.e., the diameter of the through hole 330 is smaller than or substantially equal to the diameter of the opening of the inner cavity 110. The side wall 320 of the sleeve 300 is disposed parallel against to the inner wall of the housing 102.

The mentioned-above of the sleeve 300 is preferably be a rivet, and the material of the sleeve 300 preferably includes nickel, nickel alloy, nickel copper alloy, titanium alloy, yttrium alloy, chromium alloy, platinum, or other conductive materials.

Figure 5:
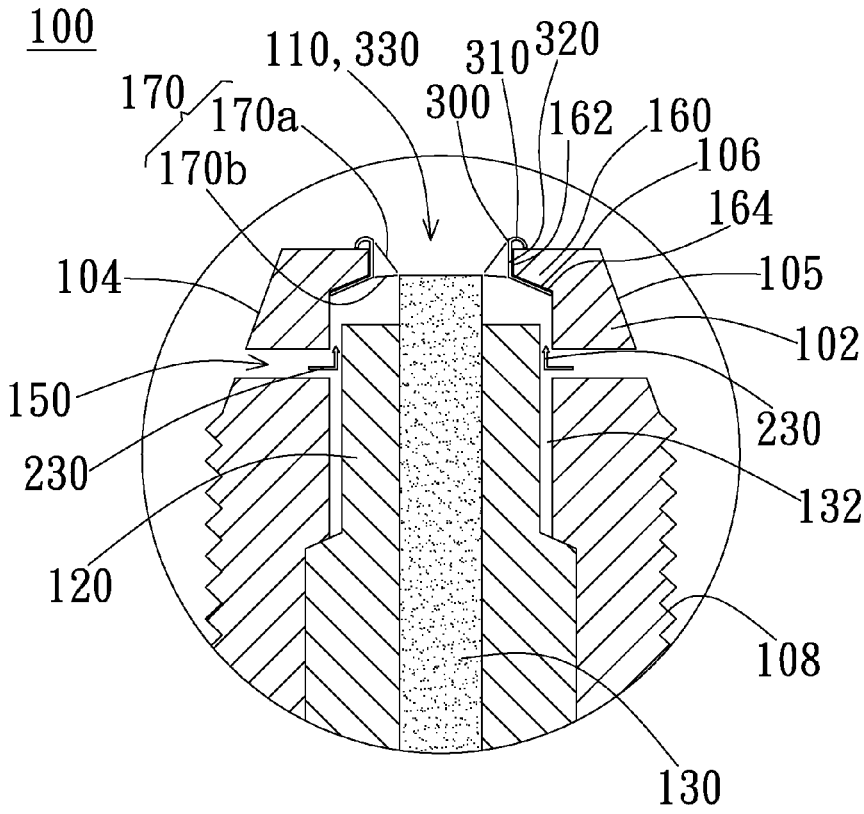
FIG. 5 illustrates a perspective view of the fuel-air mixture entering from the through hole of the spark plug of the present invention.

Due to the point discharge phenomenon of electricity forms selectively an electric current at the position of the lowest resistance when the spark plug 100 is electrically conducted. However, in other circumstances, the electricity may form selectively a discharge spark along a shortest path. As FIG. 5 shown, when the spark plug 100 conducts and form an electric circuit, the discharge spark 170 may form between an end of the sleeve 300 and the edge surface of the central electrode 130, i.e. the bending portion 310 corresponding to a point between the plane 162 of the wall surface of the sleeve 300 and the edge surface of the central electrode 130 (170*a*.) However, in other embodiments, the discharge spark 170*a* may form between the sleeve 300 corresponding to any points of the inner wall surface of the plane 162 and the edge surface of the central electrode 130.

The discharge spark 170*b* may form along a point of the shortest path between the edge surface of the central electrode 130 and the sleeve 300. In the embodiment of shown in FIG. 5, the discharge spark 170*b* preferably forms between the bending point of the sleeve 300 and the edge surface of the central electrode 130. The mentioned-above of the bending point of the sleeve 300 is a point which connects corresponding to the surface 162 of the protrusion 160 and the inclined surface 164.

Furthermore, in the preferable embodiment, a plurality of through holes 150 are disposed on the housing 102, and the level of the through hole 150 is lower than the level of the edge surface of the ceramic insulator 120. The fuel-air mixture may enter from the opening of the inner cavity 110 or enter from the through hole 150 while a large of the fuel-air mixture diffuse all around of the spark plug 100. When the fuel-air mixture 230 enter from the through hole 150, the fuel-air mixture 230 may impact the sidewall of the ceramic insulator 120 and would not directly affects the discharge sparks 170*a*, 170*b* which forms between the edge surface of the central electrode 130 and the inner sidewall of the sleeve 300 or between the edge surface of the central electrode 130 and the bending point of the sleeve 300. Besides, the disposed of the through hole 150 may help the fuel-air mixture 230 entering into the inner cavity 110 and assists the spark plug 100 to ignite fire. The accumulation of greasy filth may overfill form the through hole 150 and would not affect the formed discharge spark 170.

When the fuel-air mixture 230 enter from the opening of the inner cavity 110, the fuel-air mixture 230 may enter into the inner cavity 110 before impact the plane 104 indirectly, and then ignites fire with the formed discharge spark 170, thus the fuel-air mixture 230 would not affect the discharge spark 170 directly. In addiction, the protrusion 160 of the housing 102 protrudes towards the inner cavity 110, so as to increase the moveable length of the fuel-air mixture 230. In other words, the disposed of the protrusion 160 can increase the protection of the discharge spark 170 and would not snuff out by the large amount of the fuel-air mixture 230.

Figure 6:
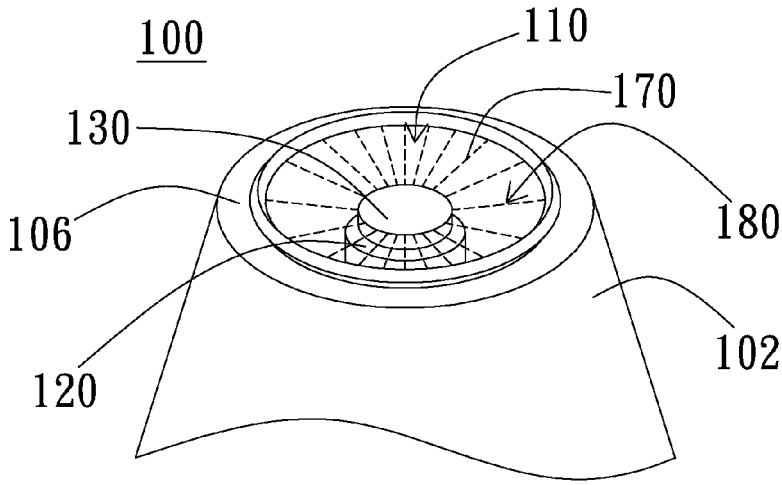
FIG. 6 illustrates a perspective view of the spark plug occurring a discharge spark according to the present invention.

As FIG. 6 shown, an inclined continuous surface 180, the discharge spark 170, is preferably formed between the inner sidewall of the sleeve 300 and the edge surface of the central electrode 130. The mentioned-above of the continuous surface 180 includes forming in the inner cavity 110 at any ranges for 360 degrees. In fact, the range of angles of the discharge spark 170 may depend on the different electricity, the material of the sleeve 300 or other facts. Therefore, in other embodiments, the discharge spark 170 formed on the continuous surface 180 may also be a portion, a segment or other incompleted discharge spark.

Figure 7:
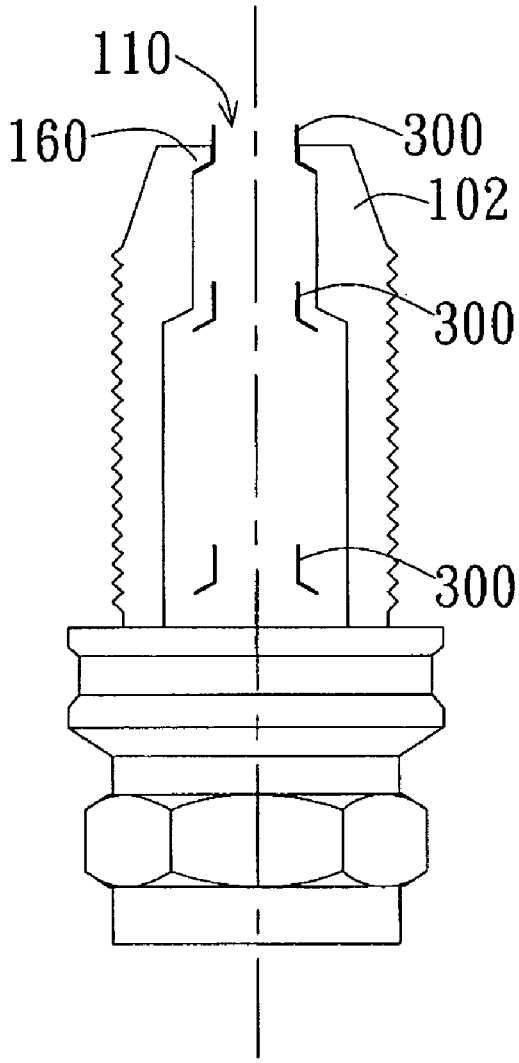
FIG. 7 illustrates a perspective view of the sleeve assembled the spark plug of the present invention.
Figure 8A:
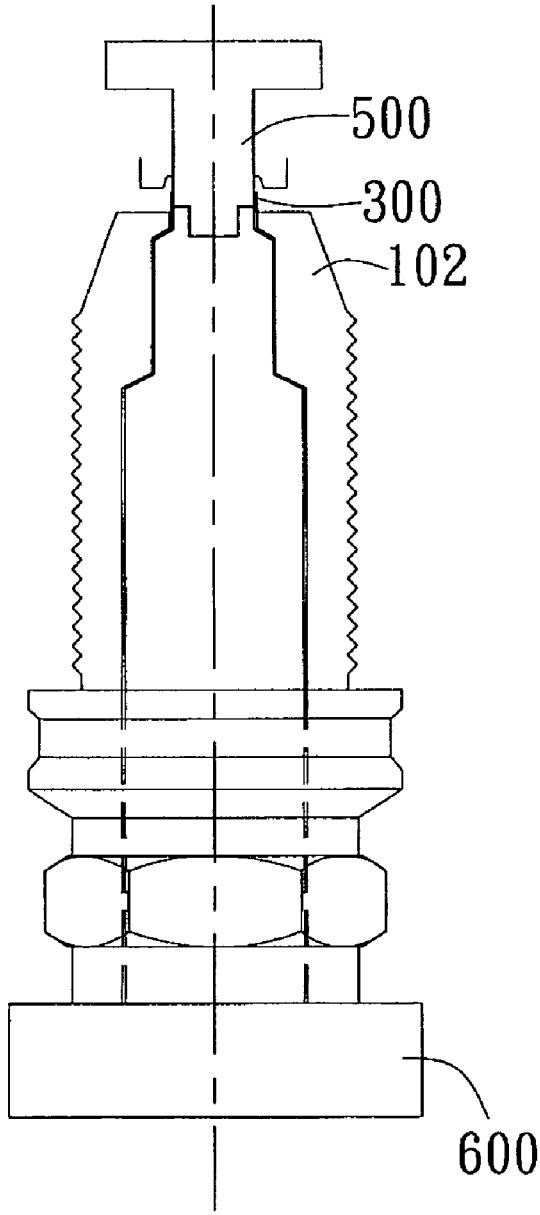
FIG. 8*a* illustrates a first movement view of pressing the sleeve of the present invention.
Figure 8B:
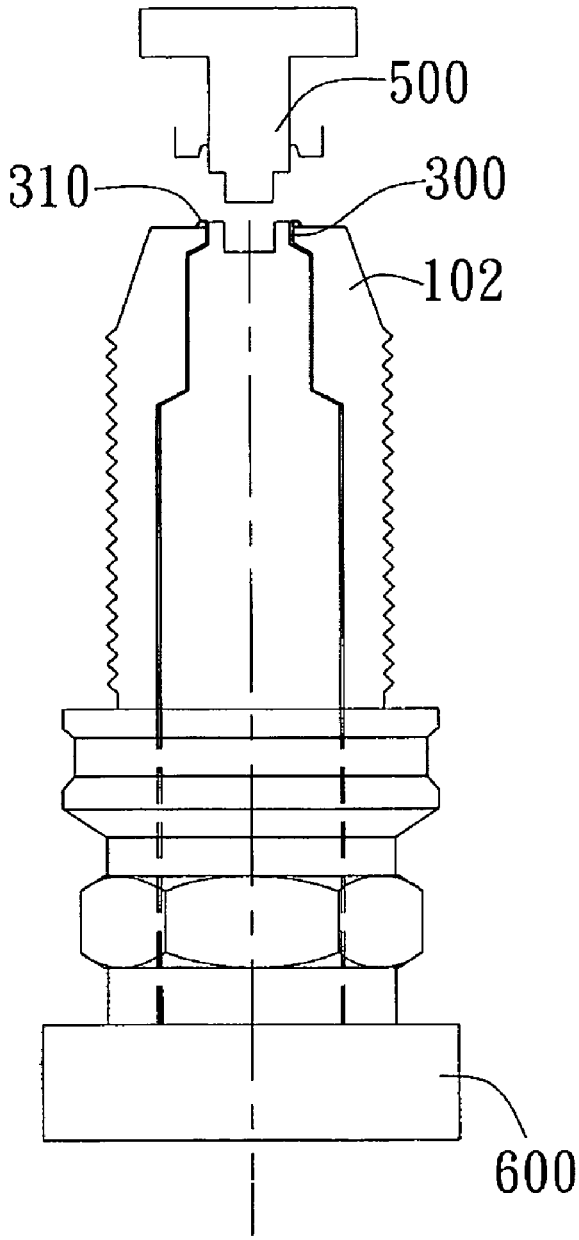
FIG. 8*b* illustrates a second movement view of pressing the sleeve of the present invention.
Figure 8C:
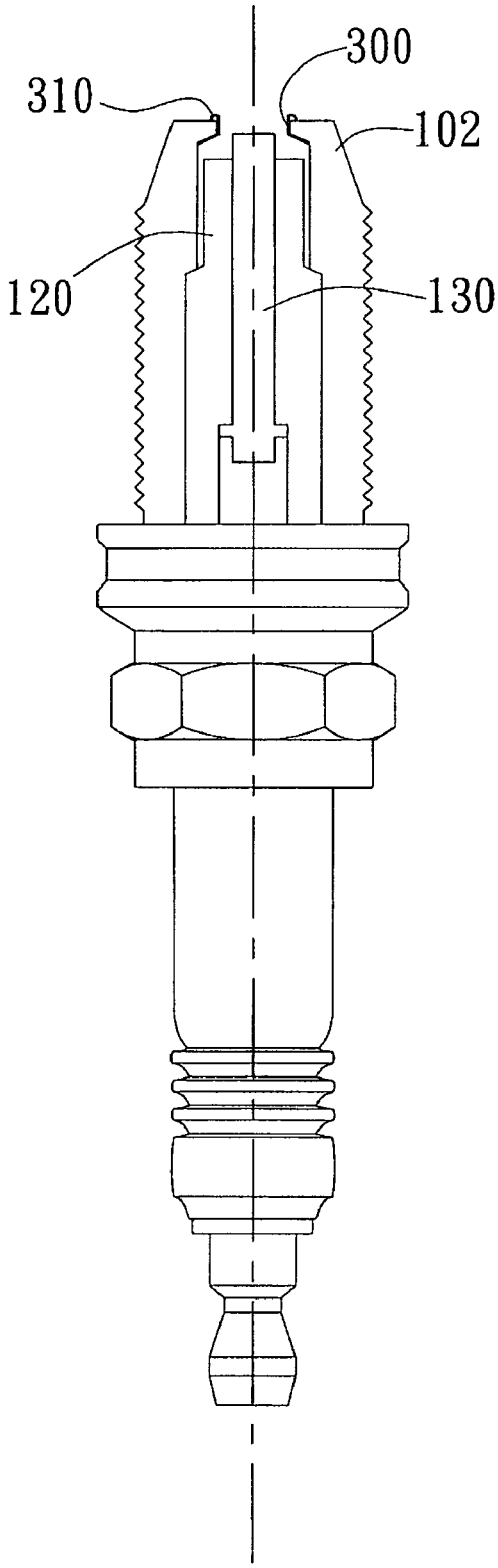
FIG. 8*c* illustrates a perspective view of taking apart from a machine tool and further assembled the ceramic insulator of the present invention.

FIG. 7 illustrates a perspective view of the sleeve assembling the spark plug of the present invention. The step of assemble methods of the sleeve 300 are, the sleeve 300 assembles upwards from bottom end of the inner cavity 110 of the housing 102 until engages with the protrusion 160 of the housing 102. As FIG. 8*a* and FIG. 8*b* shown, the housing 102 may fabricate on a machine tool 600, and utilizes a pressed device 500 to press a top end of the sleeve 300, the top end of the sleeve 300 becomes a bending portion 310 so as to position at the inner sidewall of the housing 102, shows in FIG. 8*b*. As FIG. 8*c* shown, after finished the pressing method, they can be assembled the ceramic insulator 120, the central electrode 130 and other elements.

Figure 9:
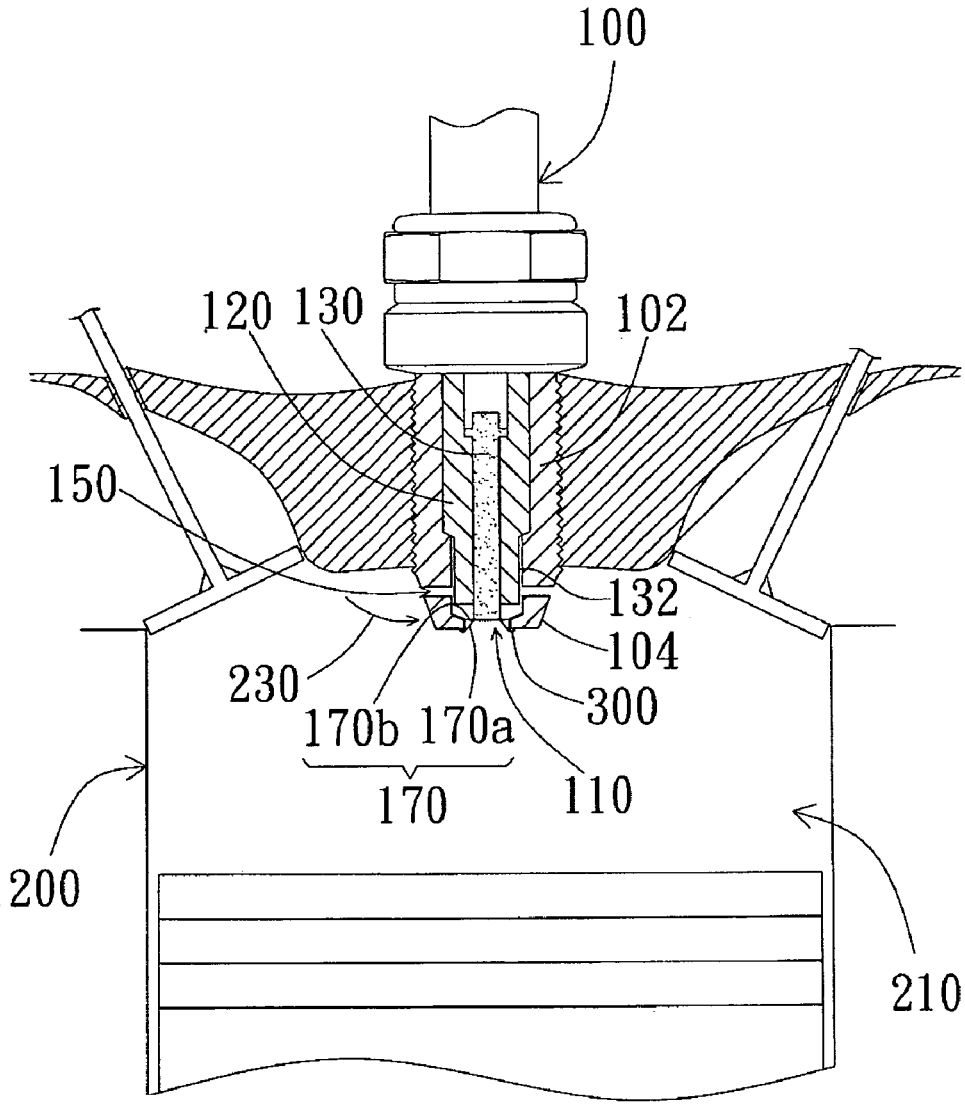
FIG. 9 illustrates an embodiment view of the spark plug disposed on the engine of the present invention.

FIG. 9 illustrates an embodiment view of the spark plug disposed on the engine of the present invention. The spark 100 engages with a cylinder of the engine 200 by uses the outside screw 108 of the housing 102. When the fuel-air mixture 230 enters into the combustion chamber 210, the inclined surface 104 will guide the fuel-air mixture 230 spread rapidly, and speedily contacts and ignites the formed discharge spark 170. More particularly, when treads on the gas pedal hardly, the large amount of the high pressure fuel-air mixture 230 will enter into the combustion chamber 210 rapidly. Because the protection of the protrusion 160 of the housing 102, the discharge spark 170 which hides and forms between the inner sidewall of the sleeve 300 and the central electrode 130 would not impact or snuffed out by the fuel-air mixture 230 directly.

The fuel-air mixture 230 may indeed enter into the inner cavity 110 from the through hole 150 rapidly, but block by the ceramic insulator 120 to reduce the impaction of the large amount of the fuel-air mixture 230. In other words, the spark 100 may still ignite fire smoothly and the engine 200 may keep on operating in this circumstance.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A spark plug, comprising:

a housing having an inner cavity;

a ceramic insulator enclosing a central electrode, the ceramic insulator disposed inside the inner cavity, and a gap is formed between the ceramic insulator and the housing; and a sleeve having a bending portion bent outward from on one end of the sleeve and in contact with the housing, the sleeve enclosing an inner wall of the housing and corresponding to an opening of the inner cavity, wherein the level of an edge surface of the housing corresponding to the opening of the inner cavity is disposed higher than the level of an edge surface of the central electrode, and the level of the center electrode is also higher than the level of the edge surface of the ceramic insulator.

2. The spark plug of claim 1, wherein the housing further includes a protrusion corresponding to the opening of the inner cavity, the level of the protrusion is higher than the level of the edge surface of the central electrode, and an inner diameter of the protrusion is smaller than the inner diameter of the inner cavity.

3. The spark plug of claim 1, wherein an incline surface is further disposed on an outside fringe of the housing, and the incline surface has a top end surface, wherein the bending portion contacts with the top end surface.

4. The spark plug of claim 2, wherein the protrusion has a plane connected to the top end surface, and the plane is parallel to a sidewall surface of the central electrode.

5. The spark plug of claim 1, wherein the housing further includes at least one through hole which connects horizontally from an outer sidewall of the housing to the gap.

6. The spark plug of claim 5, wherein the level of the through hole is lower than the edge surface of the ceramic insulator.

7. The spark plug of claim 1, wherein a continuous surface forms between one end of the sleeve and the central electrode, and a discharge spark is generated from the continuous surface.

8. The spark plug of claim 1, wherein a continuous surface forms between the central electrode and an inner sidewall of the sleeve, and a discharge spark is generated from the continuous surface.

9. A spark plug, comprising:

a housing having an inner cavity;

a ceramic insulator enclosing a central electrode, the ceramic insulator disposed inside the inner cavity, and a gap is formed between the ceramic insulator and the housing; and a sleeve having a bending portion bent outward from on one end of the sleeve and in contact with the housing, the sleeve enclosing an inner wall of the housing and corresponding to an opening of the inner cavity, wherein an outer sidewall of the housing corresponding to the opening of the inner cavity protrudes out from the edge surface of the central electrode, and the edge surface of the central electrode also protrudes out from the edge surface of the ceramic insulator.

10. The spark plug of claim 9, wherein the housing further has a protrusion corresponding to the opening of the inner cavity, the level of the protrusion is higher than the edge surface of the central electrode, and an inner diameter of the protrusion is smaller than an inner diameter of the inner cavity.

11. The spark plug of claim 9, wherein an incline surface is further disposed on an outside fringe of the housing, and the incline surface has a top end surface, wherein the bending portion contacts with the top end surface.

12. The spark plug of claim 10, wherein the protrusion has a plane connected to the top end surface, and the plane is parallel to a sidewall surface of the central electrode.

13. The spark plug of claim 9, wherein the housing further includes at least one through hole which connects horizontally from an outer sidewall of the housing to the gap.

14. The spark plug of claim 13, wherein the level of the through hole is lower than the edge surface of the ceramic insulator.

15. The spark plug of claim 9, wherein a continuous surface forms between one end of the sleeve and the central electrode, and a discharge spark is generated from the continuous surface.

16. The spark plug of claim 9, wherein a continuous surface forms between the central electrode and an inner sidewall of the sleeve, and a discharge spark is generated from the continuous surface.

17. A spark plug, comprising:

a housing having an inner cavity;

a ceramic insulator enclosing a central electrode, the ceramic insulator disposed inside the inner cavity, and a gap is formed between the ceramic insulator and the housing; and a sleeve having a bending portion bent outward from on one end of the sleeve and in contact with the housing, the sleeve enclosing an inner wall of the housing and corresponding to an opening of the inner cavity, wherein the level of the edge surface of the central electrode corresponding to the opening of the inner cavity is lower than the level of the edge surface of the housing, and the level of the edge surface of the ceramic insulator is also lower than the central electrode.

18. The spark plug of claim 17, wherein the sleeve is a rivet.

19. The spark plug of claim 1, wherein the sleeve further has a through hole and a side wall, the through hole corresponds to the opening of the inner cavity and the side wall is disposed against to the inner wall of the housing.

* * * * *